US006421872B1

(12) United States Patent
Sciandivasci

(10) Patent No.: US 6,421,872 B1
(45) Date of Patent: Jul. 23, 2002

(54) SELF-CLEANING BRUSH WITH INTERCHANGEABLE BRISTLES

(76) Inventor: Leonardo Sciandivasci, 86 Bay 11 St., Brooklyn, NY (US) 11228

( * ) Notice: Subject to any disclaimer, the term of this patent is extended or adjusted under 35 U.S.C. 154(b) by 0 days.

(21) Appl. No.: 09/490,100

(22) Filed: Jan. 24, 2000

(51) Int. Cl.[7] ..... A46B 7/00
(52) U.S. Cl. ..... 15/176.4; 15/176.1
(58) Field of Search ..... 15/176.1, 176.4, 15/176.5, 176.6

(56) References Cited

U.S. PATENT DOCUMENTS 4,118,823 A * 10/1978 Axelrod ..... 15/176.6
4,362,174 A * 12/1982 Baker ..... 15/176.1
5,005,246 A * 4/1991 Yen-Hui ..... 15/176.6
5,242,235 A * 9/1993 Li ..... 15/176.1
5,511,276 A * 4/1996 Lee ..... 15/176.6
5,904,150 A * 5/1999 Caristo ..... 15/176.4
6,237,183 B1 * 5/2001 Fischer ..... 15/176.6

FOREIGN PATENT DOCUMENTS

CH 78776 * 4/1918 ..... 15/176.5

* cited by examiner

*Primary Examiner*—Randall E. Chin

(57) ABSTRACT

A self-cleaning brush that includes a body and a bristle assembly that is interchangeably mounted to the body. The body is fork-shaped and terminates in bifurcations with grooves that extend longitudinally in their lengths, and a plate that extends from one bifurcation to the other bifurcation and is filled with a plurality of throughbores. The bristle assembly includes a backing plate that fits between the bifurcations, a plurality of bristles that depend from the backing plate and selectively pass through the plurality of throughbores, respectively.

9 Claims, 1 Drawing Sheet

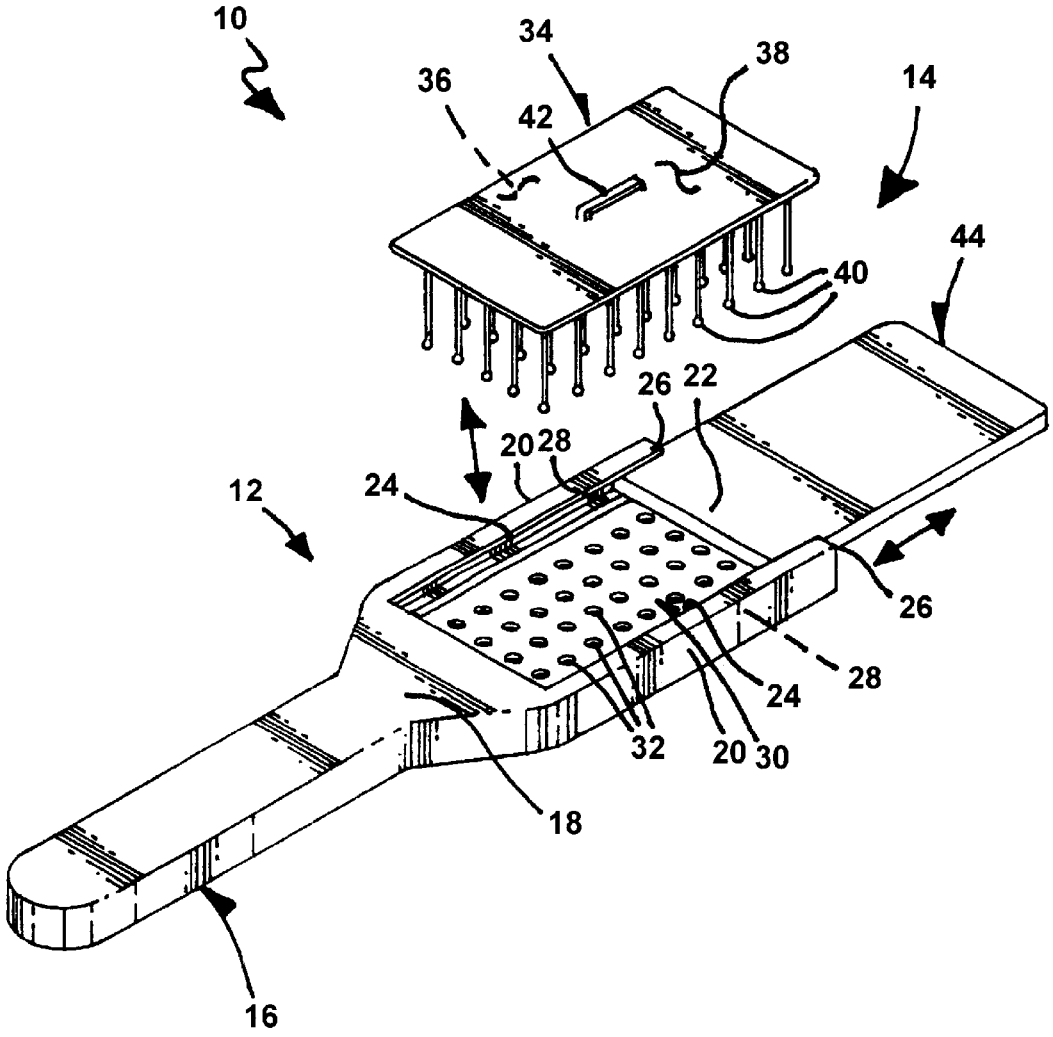
10
34
38
36
42
14
44
40
26
22
20
28
12
24
26
28
24
32
20
30
18
16

SELF-CLEANING BRUSH WITH INTERCHANGEABLE BRISTLES

BACKGROUND OF THE INVENTION

1. Field of the Invention

The present invention relates to a brush. More particularly, the present invention relates to a self-cleaning brush with interchangeable bristles.

2. Description of the Prior Art

Hairbrushes have long been used to groom humans and animals. When brushing relatively long and/or coarse hair, however, it is not uncommon for many strands of hair to be removed by the brush after only a few strokes.

Such loose strands of hair are usually trapped within the bristles of the brush. In the case where many strands of hair accumulate among the bristles, cleaning the brush can be both inconvenient and time-consuming. That is to say, the loose strands of hair are typically removed by hand from the brush, one at a time.

It would therefore be desirable to have a more efficient way to remove loose strands of hair that have become trapped with the bristles of a hairbrush during the brushing strokes, so that the brush can be quickly and easily cleaned.

Numerous innovations for brushes have been provided in the prior art that will be described. Even though these innovations may be suitable for the specific individual purposes to which they address, however, they differ from the present invention.

FOR EXAMPLE, U.S. Pat. No. 3,577,580 to Rand teaches a self-cleanable hair brush comprising a main body portion having a handle at one end, a back normally disposed in contact with one side of said main body portion, tufts of bristles secured to said back and extending through openings in said body portion, a plurality of pins rigidly secured to said body portion and normally extending through apertures provided in said back, and a U-shaped clip member pivotally secured to each pair of pins, said clip members in normal operative position of the brush being secured to the upper side of said brush, and said clip members being pivotable to a position in which the legs of the U are in alignment with said pins whereby said back and said body member may be moved away from each other to a brush cleaning position in which the cross members the U-shaped clip members constitute abutments limiting movement so that the back does not become disengaged from the tufts of bristles.

ANOTHER EXAMPLE, U.S. Pat. No. 3,765,049 to Green teaches a brush with retractable bristles which comprises an enclosure which has apertures through the top surface, a member which holds the bristles and which is movable upward and downward within the enclosure, bristles one end of which are held in the bristle holding member and the other end of which are aligned with the apertures, means for moving the bristle holding member from a position whereby the bristles extend out through the apertures to a position whereby the bristles are substantially flush with the apertures or just slightly below the apertures and means for retaining the bristle holding member in the two positions described.

STILL ANOTHER EXAMPLE, U.S. Pat. No. 3,886,617 to Labran teaches a self cleanable hair brush consisting of a back member having a handle at one end and a plurality of clumps of rooted into openings in the back member at an angle to the face of the back member. The bristle clumps pass through a moveable cleaning plate having perforations aligned with the root openings. Plunger means the plate away from the back thereby oscillating the bristles and moving any entangled hair to the edge of the bristles for easy removal therefrom.

YET ANOTHER EXAMPLE, U.S. Pat. No. 4,225,997 to Thomas et al. teaches a self-cleaning brush that comprises a body member having a hollow interior compartment and an anterior wall provided with a number of spaced apertures through which the bristles of the brush can project. A bristle supporting member, including a brush head to which the bristles are affixed, is located within the hollow compartment and has a brush head operating member attached to its upper surface which projects through an opening in a posterior wall. The brush head operating member is movable reciprocally within the hollow compartment from a first position, in which the bristles project through registering apertures in the anterior wall, to a second position, where the bristles are fully retracted within the brush body. The retraction of the bristles through the apertures in the anterior wall allows for easy removal of hair or debris from the bristles. The brush head operating member may be locked in any desired position by means of a reciprocable lever member which extends from the brush body. The inner end of the lever member constitutes a so-called "locking panel" which fits within one of a plurality of recesses located within the brush head operating member. When the lever is not engaged within one of the recesses in the brush head operating member, the brush head and bristles can be easily extended or retracted as desired.

STILL YET ANOTHER EXAMPLE, U.S. Pat. No. 4,517,703 to Koke teaches a hair brush having a foraminous guide plate with holes through which the bristles extend. The bristles have enlarged bulbous free ends, and the holes in the guide plate are larger than the stems of the bristles but smaller than the enlarged ends thereof, so that the guide plate can slide along the bristles but cannot be removed. A laminated cleaning plate has a rubber layer with bristle-receiving holes smaller than the stems of the bristles, so that the holes in the rubber layer tightly engage the bristles. The cleaning plate also has a relatively rigid support sheet with bristle-receiving holes larger than the enlarged ends of the bristles. The rubber layer is bonded to the support sheet, so that the cleaning plate can be entirely removed from the bristles for cleaning purposes, while the guide plate can be brought adjacent the free ends of the bristles to facilitate re-installation of the cleaning plate.

STILL ANOTHER EXAMPLE, U.S. Pat. No. 5,519,912 to Kawamura teaches hairbrushes having an array of bristles for grooming either humans or animals. Loose strands of hair that become trapped among the bristles during the brushing strokes are collected and relocated for quick and easy removal from the brush. The foregoing is achieved by either sliding a hair collecting plate axially along the bristles or by moving a bristle carrying plate to which the bristles are connected through a hollow brush head so that the bristles slide axially through holes formed in the top of the brush head.

It is apparent that numerous innovations for brushes have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a self-cleaning brush with interchangeable bristles that avoids the disadvantages of the prior art.

ANOTHER OBJECT of the present invention is to provide a self-cleaning brush with interchangeable bristles that is simple and inexpensive to manufacture.

STILL ANOTHER OBJECT of the present invention is to provide a self-cleaning brush with interchangeable bristles that is simple to use.

BRIEFLY STATED, YET ANOTHER OBJECT of the present invention is to provide a self-cleaning brush that includes a body and a bristle assembly that is interchangeably mounted to the body. The body is fork-shaped and terminates in bifurcations with grooves that extend longitudinally in their lengths, and a plate that extends from one bifurcation to the other bifurcation and is filled with a plurality of throughbores. The bristle assembly includes a backing plate that fits between the bifurcations, a plurality of bristles that depend from the backing plate and selectively pass through the plurality of throughbores, respectively, and when the plurality of bristles are in the plurality of throughbores, the backing plate is disposed against the plate and adjacently below the grooves, a grasp that is resilient and disposed on the backing plate, and a retaining plate that is slidably and selectively disposed in the grooves, and when the plurality of bristles pass through the plurality of throughbores and the retaining plate is in the grooves, the retaining plate presses on, and compresses, the grasp, compressingly locking the bristle assembly in place, and when the retaining plate is slide out of the grooves, the bristle assembly is free to be removed and interchanged.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The sole figure of the drawing is an exploded diagrammatic perspective view of the present invention.

LIST OF REFERENCE NUMERALS UTILIZED IN THE DRAWING

10 self-cleaning brush with interchangeable bristles of the present invention
12 body for holding in hand
14 bristle assembly
16 handle of body 12 for holding in hand
18 end of handle 16 of body 12
20 bifurcations of body 12
22 space of body 12 separating bifurcations 20 of body 12 from each other
24 faces of bifurcations 20 of body 12
26 free ends of bifurcations 20 of body 12
28 grooves in faces 24 of bifurcations 20 of body 12
30 plate of body 12
32 plurality of throughbores in plate 30 of body 12
34 backing plate of bristle assembly 14
36 interior face of backing plate 34 of bristle assembly 14
38 exterior face of backing plate 34 of bristle assembly 14
40 plurality of bristles of bristle assembly 14
42 grasp of bristle assembly 14
44 retaining plate of bristle assembly 14

DETAILED DESCRIPTION OF THE PREFERRED EMBODIMENT

Referring now to the sole figure, which is an exploded diagrammatic perspective view of the present invention, and in which like numerals indicate like parts, the self-cleaning brush with interchangeable bristles of the present invention is shown generally at 10.

The self-cleaning brush with interchangeable bristles 10 comprises a body 12 for holding in a hand, and a bristle assembly 14 that is interchangeably mounted to the body 12.

The body 12 is fork-shaped and comprises a handle 16 for holding in the hand, and which terminates in an end 18, and bifurcations 20 that extend longitudinally from the end 18 of the handle 16 of the body 12, are separated by a space 22, have faces 24 that face each other with lengths, and have free ends 26.

Both the handle 16 of the body 12 and the bifurcations 20 of the body 16 are slender and elongated.

The bifurcations 20 of the body 12 have grooves 28 that extend longitudinally in the lengths of the faces 24 of the bifurcations 20 of the body 12, from the handle 16 of the body 12 to, and opens into, the free ends 26 of the bifurcations 20 of the body 12.

The body 12 further comprises a plate 30 that extends from one bifurcation 20 of the body 12 to the other bifurcation 20 of the body 12, lies in a plane, fills the space 22 between the bifurcations 20 of the body 12, and is disposed parallel to, and slightly below, the grooves 28 in the faces 24 of the bifurcations 20 of the body 12.

The plate 30 of the body 12 is filled with a plurality of throughbores 32 that extend therethrough, perpendicularly to the plane thereof.

The bristle assembly 14 comprises a backing plate 34 that is sized to fit in the space 22 between the bifurcations 20 of the body 12, from above, and has an interior face 36 that faces the plate 30 of the body 12, and an exterior face 38 that faces opposite to the interior face 36 of the backing plate 34 of the bristle assembly 14.

The bristle assembly 14 further comprises a plurality of bristles 40 that depend from the interior face 36 of the backing plate 34 of the bristle assembly 14, and selectively pass through the plurality of throughbores 32 in the plate 30 of the body 12, respectively.

When the plurality of bristles 40 of the bristle assembly 14 pass through the plurality of throughbores 32 in the plate 30 of the body 12, the backing plate 34 of the bristle assembly 14 is disposed against the plate 30 of the body 12 and adjacently below the grooves 28 in the faces 24 of the bifurcations 20 of the body 12.

The bristle assembly 14 further comprises a grasp 42 that is resilient and disposed centrally on, and extends longitudinally along, the exterior surface 38 of the backing plate 34 of the bristle assembly 14, and assists in interchanging the bristle assembly 14 when the bristle assembly 14 having different ones of the plurality of bristles 40 of the bristle assembly 14 is desired.

The bristle assembly 14 further comprises a retaining plate 44 that is slidably and selectively disposed in the grooves 28 in the faces 24 of the bifurcations 20 of the body 12, from the free ends 26 of the bifurcations 20 of the body 12.

When the plurality of bristles 40 of the bristle assembly 14 pass through the plurality of throughbores 32 in the plate 30 of the body 12 and the retaining plate 44 of the bristle assembly 14 is in the grooves 28 in the faces 24 of the bifurcations 20 of the body 12, the retaining plate 44 of the bristle assembly 14 presses on, and compresses, the grasp 42 of the bristle assembly 14, compressingly locking the bristle assembly 14 in place, and when the retaining plate 44 of the bristle assembly 14 is slide out of the grooves 28 in the faces 24 of the bifurcations 20 of the body 20 from the free ends 26 of the bifurcations 20 of the body 12, the bristle assembly 14 is free to be removed and interchanged.

It will be understood that each of the elements described above, or two or more together, may also find a useful application in other types of constructions differing from the types described above.

While the invention has been illustrated and described as embodied in a self-cleaning brush with interchangeable bristles, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A self-cleaning brush with interchangeable bristles, comprising:

a) a body for holding in a hand; and a bristle assembly interchangeably mounted to said body;

wherein said body is fork-shaped;

wherein said body comprises:

i) a handle for holding in the hand, and which terminates in an end; and ii) bifurcations that extend longitudinally from said end of said handle of said body, are separated by a space, have faces that face each other with lengths, and have free ends;

wherein said bifurcations of said body have grooves that extend longitudinally in said lengths of said faces of said bifurcations of said body, from said handle of said body to, and opens into, said free ends of said bifurcations of said body;

wherein said body further comprises a plate that extends from one bifurcation of said body to the other bifurcation of said body, and lies in a plane; and wherein said plate of said body is filled with a plurality of throughbores that extend therethrough, perpendicularly to said plane thereof.

2. The brush as defined in claim 1, wherein said handle of said body is slender and elongated.

3. The brush as defined in claim 1, wherein said bifurcations of said body are slender and elongated.

4. The brush as defined in claim 1, wherein said plate of said body fills said space between said bifurcations of said body.

5. The brush as defined in claim 1, wherein said plate of said body is disposed parallel to, and slightly below, said grooves in said faces of said bifurcations of said body.

6. The brush as defined in claim 1, wherein said bristle assembly comprises a backing plate that is sized to fit in said space between said bifurcations of said body, from above, and has:

a) an interior face that faces said plate of said body; and b) an exterior face that faces opposite to said interior face of said backing plate of said bristle assembly.

7. The brush as defined in claim 6, wherein said bristle assembly further comprises a plurality of bristles that depend from said interior face of said backing plate of said bristle assembly, and selectively pass through said plurality of throughbores in said plate of said body, respectively, and when said plurality of bristles of said bristle assembly pass through said plurality of throughbores in said plate of said body, said backing plate of said bristle assembly is disposed against said plate of said body and adjacently below said grooves in said faces of said bifurcations of said body.

8. The brush as defined in claim 6, wherein said bristle assembly further comprises a grasp that is resilient and disposed centrally on, and extends longitudinally along, said exterior surface of said backing plate of said bristle assembly, and assists in interchanging said bristle assembly when said bristle assembly having different ones of said plurality of bristles of said bristle assembly is desired.

9. The brush as defined in claim 8, wherein said bristle assembly further comprises a retaining plate that is slidably and selectively disposed in said grooves in said faces of said bifurcations of said body, from said free ends of said bifurcations of said body, and when said plurality of bristles of said bristle assembly pass through said plurality of throughbores in said plate of said body and said retaining plate of said bristle assembly is in said grooves in said faces of said bifurcations of said body, said retaining plate of said bristle assembly presses on, and compresses, said grasp of said bristle assembly, compressingly locking said bristle assembly in place, and when said retaining plate of said bristle assembly is slide out of said grooves in said faces of said bifurcations of said body from said free ends of said bifurcations of said body, said bristle assembly is free to be removed and interchanged.

* * * * *